166-274 SR
5/14/85 XR 4,516,636

United States Patent [19]
Doscher

[11] Patent Number: 4,516,636
[45] Date of Patent: May 14, 1985

[54] ENHANCED STEAM DRIVE RECOVERY OF HEAVY OIL

[76] Inventor: Todd M. Doscher, 740 A E. Main St., Ventura, Calif. 93001

[21] Appl. No.: 452,200

[22] Filed: Dec. 22, 1982

Related U.S. Application Data

[63] Continuation-in-part of Ser. No. 342,465, Jan. 25, 1982.

[51] Int. Cl.³ ..... E21B 43/24; E21B 43/25
[52] U.S. Cl. ..... 166/272; 166/274; 166/271
[58] Field of Search ..... 166/272, 274, 271

[56] References Cited

U.S. PATENT DOCUMENTS 4,068,717 1/1978 Needham ..... 166/272
4,086,764 5/1978 Dilgren et al. ..... 166/272
4,109,720 8/1978 Allen et al. ..... 166/272
4,161,217 7/1979 Dilgren et al. ..... 166/272
4,175,618 11/1979 Wu et al. ..... 166/272
4,184,549 1/1980 Schierelbein ..... 166/272

*Primary Examiner*—Stephen J. Novosad
*Assistant Examiner*—Mark J. DelSignore
*Attorney, Agent, or Firm*—Jerry Cohen; M. Lawrence Oliverio; William E. Noonan

[57] ABSTRACT

A method for enhancing steam drive recovery of oil from an oil zone disposed below an overburden (18) including injecting a surfactant continuously into a supply (20) of driving steam to uniformly mix the surfactant with the steam and thereby provide a driving fluid. The driving fluid is then introduced into the oil zone (16) under sufficient pressure to cause the fluid to drive through a flow channel (S) between the interface I and the overburden (18) thereabove. The surfactant reacts with the oil to enable the fluid to strip away a top layer of the oil which is driven to a production well 14 for removal thereof.

7 Claims, 7 Drawing Figures

Fig. 7

| AVERAGE OIL RECOVERY | WELLS AFFECTED BY SURFACTANT | WELLS NOT AFFECTED BY SURFACTANT |
|---|---|---|
| 1980 | 90 bbl/day | 28 bbl/day |
| 1981 | 214 bbl/day | 20 bbl/day |
| 1982 * | 197 bbl/day | 17 bbl/day |
| II OIL/STEAM RATIO | | |
| 1980 | 0.15 | 0.22 |
| 1981 | 0.30 | 0.20 |
| 1982 * | 0.52 | 0.05 |
| III OIL OUT | | |
| 1982 * | 32 % | 15 % |

* Analysis based on first 6 months

ENHANCED STEAM DRIVE RECOVERY OF HEAVY OIL

This application is a continuation-in-part of copending U.S. patent application Ser. No. 342,465 filed Jan. 25, 1982, Todd M. Doscher, for "HEAVY OIL RECOVERY BY INTERFACIAL STRIPPING."

BACKGROUND OF THE INVENTION

The present invention relates to a method for enhanced oil recovery and, in particular, to an improved steam drive operation for recovering heavy oils.

A variety of fluent driving media (e.g. compressed air, steam, $CO_2$, water) are presently employed for recovering heavy oil from the underground strata in which such oil is typically trapped. Of these media, steam is the most widely used. However, as the oil zone is gradually depleted, oil recovery rates decrease markedly and/or the quantity of steam required to produce a barrel of oil (the steam to oil ratio) increases markedly. In order to maintain an adequate recovery rate, the rate and amount of driving steam and thus the energy required to produce such steam must be escalated. Consequently, over time, the steam to oil ratio increases and steam drive efficiency is lowered.

In an attempt to enhance the efficiency of the operation, a number of methods introduce a chemical additive such as a surface active agent (surfactant) to the steam drive. For example, see U.S. Pat. Nos. 3,412,793 and 4,086,964. In each of these processes, a discrete slug of surfactant is injected into the steam drive with the intent to create a foam block in the depleted oil zone. The steam/surfactant foam block is then followed by additional driving steam minus surfactant. The prior art postulates that the high permeability oil depleted zone is plugged by foam and the following steam is diverted by the foam block into the low permeability oil containing zone where it drives the trapped oil toward a production well. An increased pressure gradient, effected by emplacement of the foam, theoretically enhances oil recovery and efficiency of the steam drive operation.

In other processes, particularly in a lighter oil context, surfactant is employed with a non-condensible gas or a liquid such as water to enhance oil recovery. Again, discrete slugs of surfactant are introduced into the oil resevoir. For example, in the process of chemical flooding, surfactant (plus non-condensible gas) may be introduced into the resevoir for months to mobilize the oil trapped therein. An aqueous driving fluid is then injected to follow the surfactant and drive the oil toward a production well.

It may be noted that in each of the prior methods of utilizing surfactant to enhance oil recovery, the surfactant is employed to implement a piston model of driving medium in relation to the oil to be recovered. Despite the use of surfactants in such prior art, valuable additional oil typically remains trapped in the resevoir and efficiency is often less than optimally desirable. Following a certain period of steam drive operation, the level of oil recovery may become so low compared with the steam producing energy required (e.g. the steam/oil ratio may become so great) that the operation falls below the break-even point of economic or even energy feasibility. Energy feasibility occurs below 15 barrels of water equivalent steam per barrel of oil, whereas economic break-even occurs below approximately 9 barrels of steam per barrel of oil in the current economic milieu.

SUMMARY OF THE INVENTION

It is therefore an object of this invention to provide a method for enhancing steam drive recovery of oil which reduces the steam/oil ratio (e.g. the amount of steam required for recovering each barrel of oil from an oil zone) to thereby improve energy and economic efficiency.

It is a further object of this invention to provide a method for enhancing steam drive recovery of oil which enables an increased amount of trapped oil to be recovered from the fine pores of an underground formation.

It is a further object of this invention to provide a method for enhancing the steam drive recovery of heavy oils which provides for a more efficient utilization of surfactant to assist in recovering heavy oil than exhibited by the prior art.

This invention results from a realization that steam drive recovery of heavy oil deposits may be dramatically enhanced by utilizing a surface active agent (surfactant) in the driving medium to act directly upon (e.g. react with) the interface of the oil formation and thereby assist in the displacement and transport of the oil to a recovery well. Whereas in prior heavy oil/steam drive applications, surfactant has been totally segregated from the oil and mixed with the steam in discrete slugs to form a foam blocking agent, this invention employs surfactant not as a blocking agent to plug the depleted oil zone and thus enhance the pressure gradient, but rather as an agent for directly and physically reacting with the interfacial oil layer.

This invention also recognizes that, as opposed to the piston model of displacing and driving trapped oil typically contemplated by the prior art, a preferred model is that of interfacial stripping wherein successive interfacial layers of oil are stripped from top to bottom by the steam drive. See my U.S. patent application Ser. No. 3,424,65—filed on Jan. 25, 1982. regarding HEAVY OIL RECOVERY BY INTERFACIAL STRIPPING.

Therefore, this invention features a method of enhanced steam drive recovery of oil from an oil zone disposed below an overburden including injecting a surface active agent (surfactant) continuously into a supply of driving steam to uniformly mix the surfactant with the steam and thereby provide a driving fluid. The mixture of surfactant and steam is then introduced into the oil bearing reservoir under sufficient pressure to cause the fluid to drive through a flow channel between the interface of the oil zone and the steam zone thereabove. Consequently, the surfactant reacts with the oil to enable the driving fluid to strip away a top layer of the oil which is driven to a production well for removal thereof.

In a preferred embodiment, the driving fluid may be introduced into the oil zone via an injection well and, typically, injection and production wells are made to straddle at least a portion of the oil zone. A fluid not containing surfactant, such as driving steam alone, may be injected into the reservoir prior to introducing the steam/surfactant mixture in order to develop, in whole or in part, a highly conductive channel for fluids between the injection and production wells. Alternatively, a hydraulic fracture may be induced in the reservoir between the injection and production wells. The mixture is preferrably introduced into the oil zone at a rate of between 50 and 150 barrels of water equivalent per day, per acre of oil zone projection. Further, the introduction rate may be limited to between 50 and 300 barrels of water equivalent per day. By maintaining the latter upper limit, heat loss through the overburden is minimized as is taught by my U.S. patent application Ser. No. 342,465.

The surfactant may include petroleum sulfonate, thermophoam (TM) BW-D, Suntech 4, or any surfactant which has sufficient heat stability for it to promote the dispersion of the heated oil in the mixture of steam condensate and reservoir water that is created in the reservoir, and for its effectiveness to survive in the steam heated reservoir. Criticality is not associated with the choice of the surfactant although in the future, surfactants of superior ability may be developed expressly for the specified role.

Preferably, the mixed driving fluid includes at least a 0.05% concentration but no more than a 1.0% concentration of surfactant by weight in the total steam/water mixture injected into the formation.

The surfactant, which remains dissolved in aqueous liquid solution when mixed with the steam and transported by the latter through the channel between the oil zone and the overburden or other impermeable interface thereabove, progressively drains downward to the surface of the oil zone exposed to the steam.

The present invention should not be limited to a particular explanation or mechanism for providing the enhanced recovery (viz. displacement and transport) of oil. Rather, the following models are provided as illustrative of the principles which may be involved in such recovery. The surfactant solution physically reacts with the oil to enhance steam drive displacement and transport of the interfacial layer of heated oil according to one or more of several alternate models:

(a) Laminar or film flow model:

In a conventional steam drive, the driving steam may be viewed as causing a layer of oil adjacent to the steam zone above it to flow due to the heating, velocity and pressure gradient of the steam being driven through the reservoir. The added surfactant falling on to the oil throughout the reservoir acts to further reduce the interfacial tension of this oil film and thus enables it to be displaced and transported by the steam (viz. to flow) at an enhanced rate.

(b) Emulsion model:

In a conventional steam drive, the hot steam condenses to form liquid water which mixes with the heated interfacial oil layer and any original reservoir brine that is present to produce a dispersion of oil in water, an emulsion. The term "emulsion", as used in this art, denotes any mixture of oily material with an aqueous fluid, without any regard to the stability of such an emulsion. The surfactant added in the manner taught by this invention will promote the ease with which the oil is dispersed in the external, continuous aqueous phase so that the oil is carred along at a viscosity not much different than that of the aqueous phase.

(c) Turbulence model:

In a conventional steam drive, it is postulated that the hot steam being driven under a condition of high velocity contributes to turbulence of the heated interfacial oil layer which permits the steam to strip away this turbulent oil.

According to this model of the invention, the surfactant, by lowering the interfacial tension and interfacial viscosity, promotes the dispersion of the turbulent oil within the flowing steam and steam condensate.

Therefore, under each of the three proposed models for displacement and transport of the interfacial oil layer, the effective viscosity of the oil layer relative to the driving mixture is reduced. The heating, velocity and pressure gradient of the steam drive contribute to this reduction in oil viscosity. However, the direct action of the surfactant upon the oil according to the dictates of this invention acts to greatly enhance such reduction of oil viscosity and thus reduces the amount of heating, levels required of the steam drive. For example, in a conventional steam drive a certain velocity (e.g. steam injection rate) is typically required to provide sufficient mechanical force to mobilize and displace the heated oil. In the enhanced steam drive of this invention, the interfacial tension and effective viscosity of the heated oil is reduced chemically by the direct action of the surfactant upon the oil. Actual velocity, and therefore steam injection rate, may therefore be reduced. Enhanced oil recovery and energy savings are thus realized.

A non-condensible gas, such as air, $CO_2$, nitrogen or fluegases also may be injected continuously or intermittently into the reservoir along with the steam and surfactant in order to promote both the distribution of the surfactant solution throughout the reservoir and the displacement of the heated crude without the need for wasteful use of the heat carrying steam for such purposes.

Other objects, features and advantages of the invention will be apparent from the following detailed description of preferred embodiments with reference therein to the accompanying drawing in which:

BRIEF DESCRIPTION OF THE DRAWING

FIG. 7 is a table illustrating test results, realized from all twelve production wells of FIG. 3, which compare oil recovery from wells affected by the method of this invention with those wells not so affected.

DETAILED DESCRIPTION OF PREFERRED EMBODIMENTS

Figure 1:
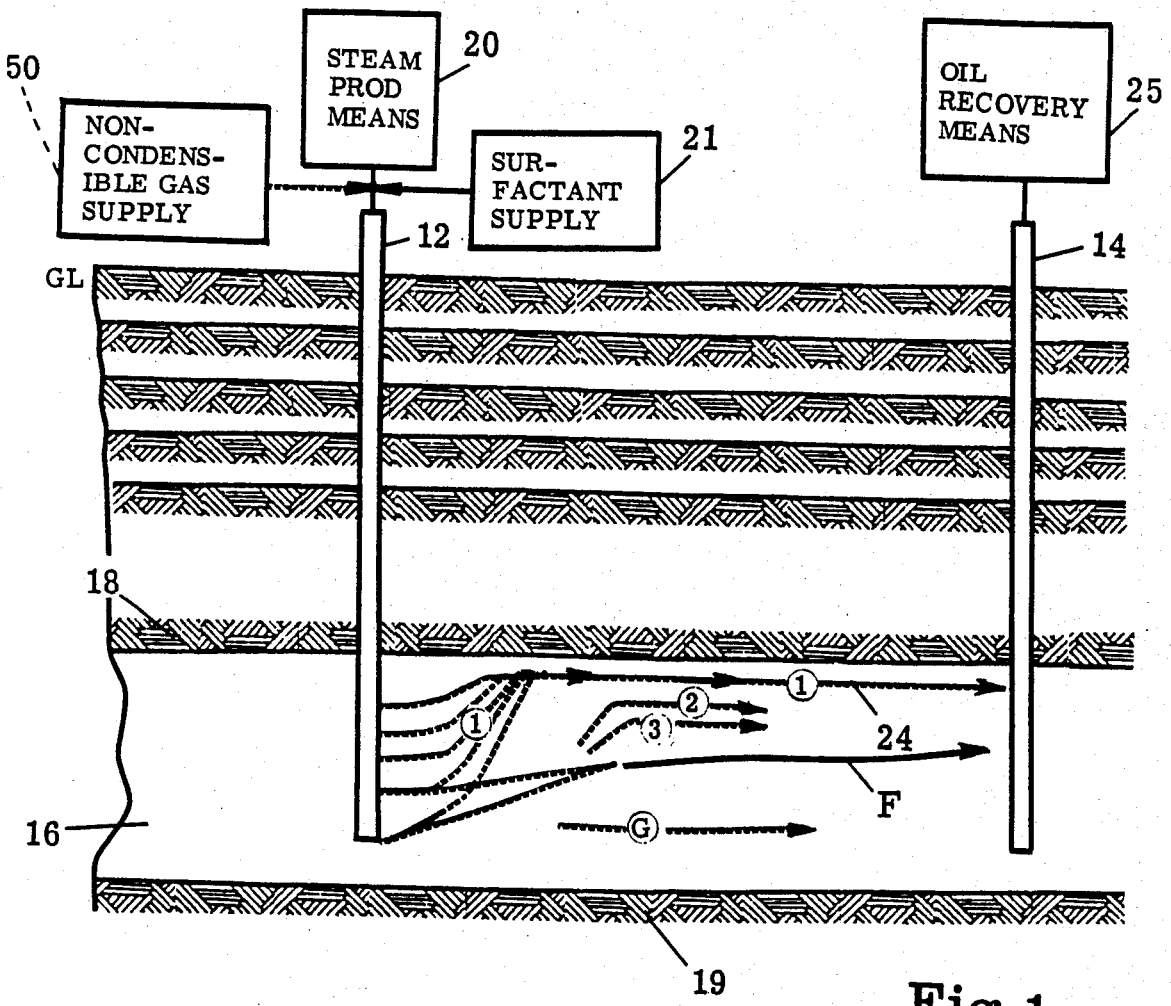
FIGS. 1 and 2 are cross sectional and partly schemetic views of an oil reservoir illustrating practice of preferred embodiments of the method of this invention.
Figure 3:
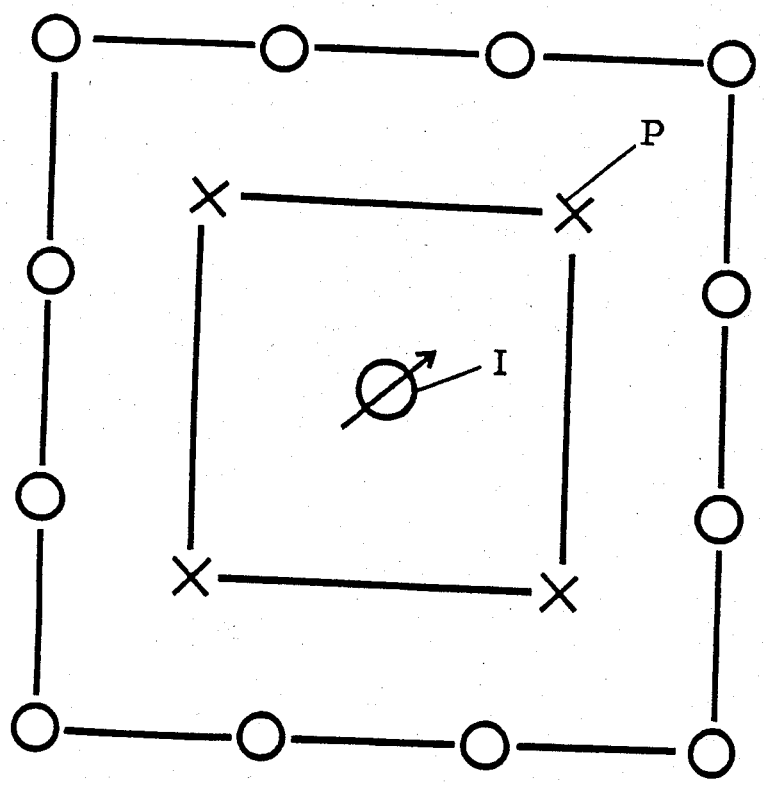
FIG. 3 is a diagrammatic view of an oil field pattern upon which the enhanced method of oil recovery of this invention was tested.

In a preferred embodiment of this invention, FIG. 1, an injection well 12 and production well 14 straddle a heavy oil zone 16 located beneath overburden 18. Typically, wells 12 and 14 are part of a larger well pattern, such as the five spot pattern, shown in FIG. 3 including injection well I and production well X.

Each well extends from ground level GL through overburden 18 and into a self-sustaining oil zone 16 and terminates proximate the bottom 19 of zone 16. Conventional steam producing means 20 provides a driving steam to injection well 12. According to this invention, surfactant from a supply 21 is continuously injected into the driving steam so as to uniformly mix therein and form a driving fluid mixture. The surfactant remains as a dispersed liquid phase. This mixture is introduced via well 12 into oil zone 16. The injection rate may range from 50 barrels of water equivalent steam per day per acre of oil zone projection to several thousand barrels per day. However, to avoid excessive fractional heat loss to the earth from well 12, which increases with a low rate of steam injection, and to avoid excessive circulation of uncondensed steam to producing well 14, the injection rate is optimized. An optimal value is 75 to 150 barrels of steam per day per projected acre of the repeated pattern of wells.

The steam-surfactant driving fluid enters oil zone through perforations along the length of well 12. Because the steam is less dense than the material comprising the oil zone 16, it will rise to the top 22 of zone 16 to meet the cap rock, or any impermeable layer, shale, anhydrite, etc., and will then be driven toward the production well 14. The channel through which the steam is driven may be a zone of (a) natural depletion, (b) fracture, (c) high water saturation, or (d) depletion induced by rising steam and drainage of heated oil. If the channel is initially due to (a), (b), or (c); it may not initially be located at the top of the oil zone 16, but subsequent heating and drainage of oil will cause the channel to move upwards toward the overburden or impermeable layer within the oil zone. A fluid such as steam alone may be introduced into the zone 16 prior to injection of the driving fluid, in order to develop such a conductive channel between the injection and production wells 12, 14. Alternatively, a fracture may be hydraulically induced between the wells.

The channel through which the steam is driven widens as the steam strips off successive layers 1, 2, 3, . . . n of oil heated at the interface of the steam channel and the oil column. The surfactant in the driving fluid drains downwards to the oil interface and there reacts with the oil to accelerate the removal of the oil towards the producing well 14, wherefrom the oil is recovered along with steam condensate and surfactant by oil recovery means 25.

As the layer of oil at top of zone 16 is swept up (e.g. displaced and transported), the top of the oil saturated portion of the zone 16 is progressively lowered. As driving fluid continues to be injected at the above rate, it is driven through the enlarged flow channel (viz. the depleted oil zone) between overburden 18 and the progressively lowered top of oil zone 16. In particular, the fluid is driven, as indicated by lines 1, 2, 3, . . . n, along the interface of the depleted oil saturated zone 16 thereby stripping and entraining additional layers of oil. (Note: that the steam/surfactant driving fluid, in fact, fills the entire cross sectional space between line 2 and overburden 18). Subsequent heating, displacement and transportation of each succeeding layer of oil is performed in the above described manner; along line 3 and so on down to line n; (e.g. successive layers of oil are removed from the oil zone by oblative erosion most likely performed by one of the three models heretofore presented. This stripping is greatly enhanced by the presence of surfactant in the driving fluid. It should be noted that the gap between successive line 1—n is greatly exaggerated for ease of illustration. In fact, each layer is extremely thin (viz. microscopic) in thickness and a vast number of layers must be stripped (e.g. n is very large) in order to totally deplete oil zone 16.

Figure 2:
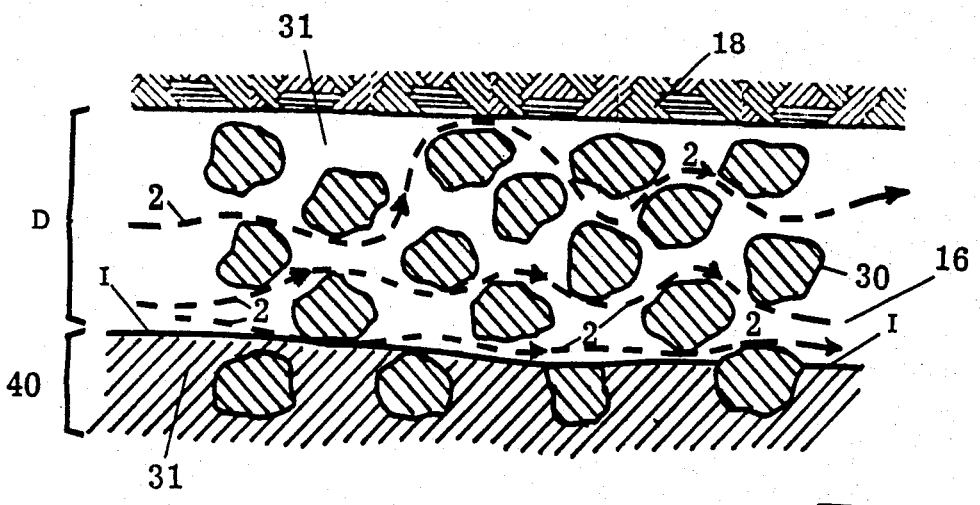

A microscopic view of the process of this invention is shown in FIG. 2. Therein oil zone 16 below overburden 18 includes sustaining structures 30 such as sandstone grains. Oil is typically trapped in the extremely fine pores 31 (greatly enlarged for clarity) between sandstone structures 30. Layer D of oil zone 16 is illustrated as swept clean of oil, corresponding to the layer stripped of oil above line 1, FIG. 1.

The steam-surfactant driving fluid is injected into zone 16 and drives as indicated by dashed lines 2 through the depleted layer D between overburden 18 and interface I of the oil zone 16. Surfactant, which is uniformly dispersed in the driving fluid injected into zone 16 drains downward to interface I and into the oil saturated zone 0. A thin layer of oil along interface I is thus displaced under the combined reaction of the heated oil with the surfactant and the condensing steam from oil saturated zone 40 and transported by the driving fluid, according to one of the stripping models presented above, to production well 14, FIG. 1, for recovery thereby.

By introducing a fluid wherein the steam quality is sufficiently high, (e.g. at least 40%) the steam phase of the driving fluid is typically maintained for a long enough distance along interface I such that the surfactant therein is delivered along the entire length of oil interface I. Accordingly, surfactant is enabled to drop out over the entire interface area. However, if steam quality or injection rate drop below certain levels, it is possible that the steam may prematurely condense thereby causing surfactant to fall out with the condensing steam before coursing over a great fraction of the length of interface I. When this happens, the surfactant is not spread evenly throughout the oil interface. Oil recovery rates are therefore hindered.

To remedy the above problem, a non-condensible gas, such as air, $CO_2$, nitrogen or exhaust gases from a supply 50, FIG. 1, may be injected intermittently or continuously at a rate of at least 100,000 standard cubic feet per day but no greater than 10,000,000 standard cubic feet per day into the driving fluid (the steam-surfactant mixture). The non-condensible gas thus becomes part of the driving fluid and is driven along with the rest of the fluid through the successive oil depleted flow channels provided as each top layer of oil is stripped away. Under pressure and temperature conditions such as are typically found in oil depleted zone D, FIG. 2, such non-condensible gas remains in a largely gaseous phase and thus serves to assist in carrying at least some surfactant along the entire length of the oil interface (e.g. along lines 1, 2—n, FIG. 1, interface I, FIG. 3) so that such surfactant drops out over the entire extent of the interface. Surfactant is accordingly spread throughout the interfacial layer of oil and thereby enhances uniform stripping and recovery of the oil according to one of the heretofore presented models.

The level of enhanced oil recovery provided by utilizing the process of this invention is best illustrated by the results of a test performed upon a sample of heavy oil reservoir. The subject reservoir was the Midway-Sunset Field in Kern Co., Calif., the largest heavy oil field in the United States. A five spot pattern P, FIG. 3, was investigated and production levels measured from the four production wells X. Twelve second ring production wells, represented by circles, were also investigated. It was determined that eight of these wells were affected by injection of surfactant as taught by this invention; whereas four were not affected. A control group was thus provided for comparing test results of affected and unaffected wells.

The five spot pattern was initially tested during its last stages of conventional steam drive, from January through October 1980, (immediately prior to normal abandonment) and its production levels during that period were measured. Then a driving fluid mixture, as described above, including steam, non-condensible gas (air and nitrogen both employed) and a low concentration of 0.1% of petroleum sulfonate surfactant in the injected driving fluid were injected, via injection well IW, from November, 1980 through May, 1981. Conventional steam drive followed from April through most of September, 1981. Finally, a high concentration, 0.4% of surfactant in a steam and air driving fluid was injected into the oil zone from late September, 1981 until mid-January, 1982.

Figure 4:
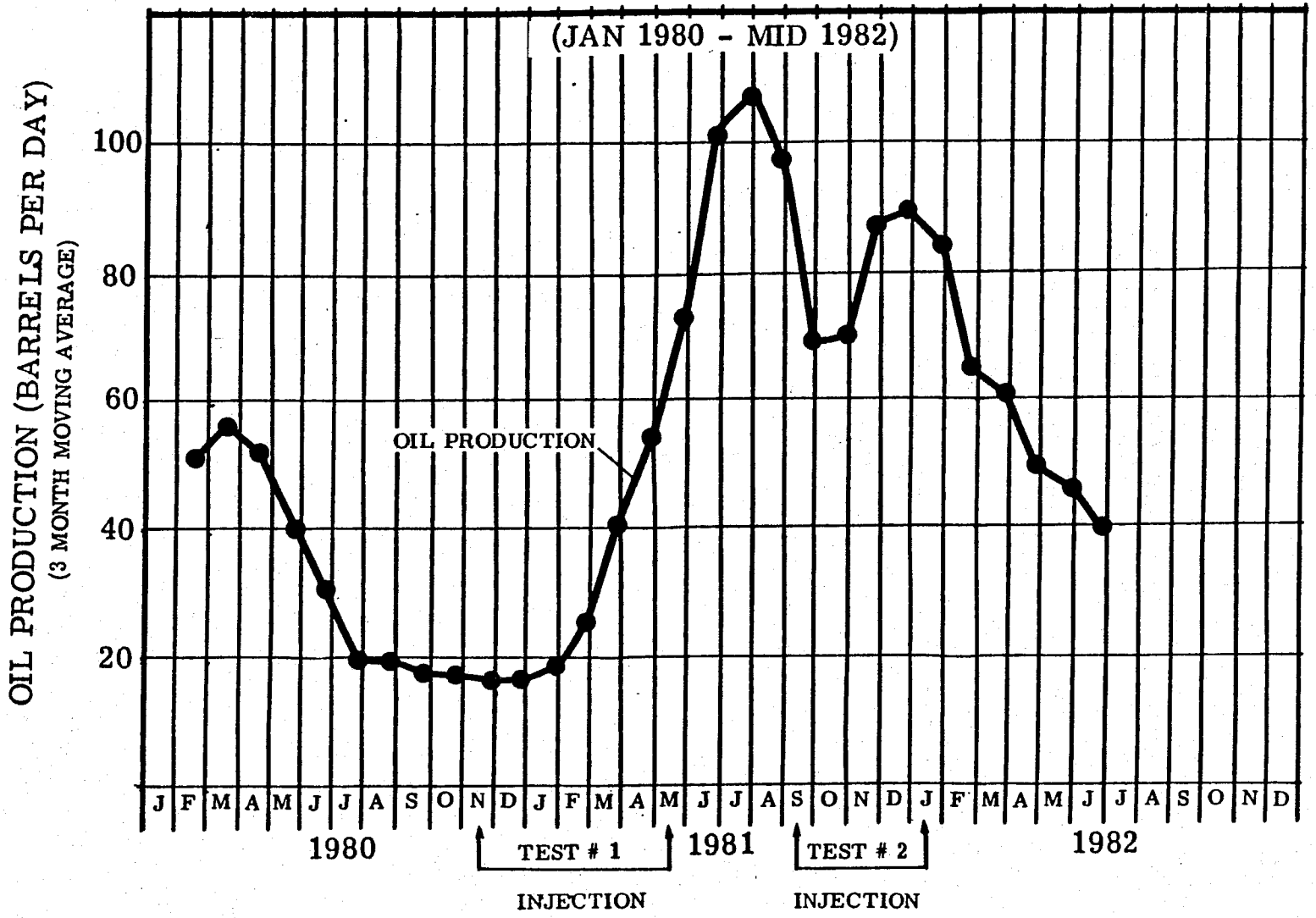
FIGS. 4–6 are graphs illustrating test results realized from the five spot pattern of FIG. 3.

As can be seen from the graph of FIG. 4, oil production rates from the production wells X, using only conventional steam drive, had dropped to 17 barrels per day immediately prior to the first enhanced driving fluid injection in November of 1981. During the process taught by this invention, the recovery rate rose dramatically, peaking at almost 109 barrels per day in June of 1981, shortly after introduction of the steam, surfactant and non-condensible gas driving fluid mixture was ceased. In fact, the average oil recovery from February through August, 1981, was 72 barrels per day. A steady drop-off in oil production ensued until the second high surfactant concentration test commenced in September, 1981. Oil production again rose to a peak of almost 90 barrels per day in December, 1981 to January, 1982 exhibiting an average of 72 barrels per day from November, 1981 through March, 1982.

Figure 5:
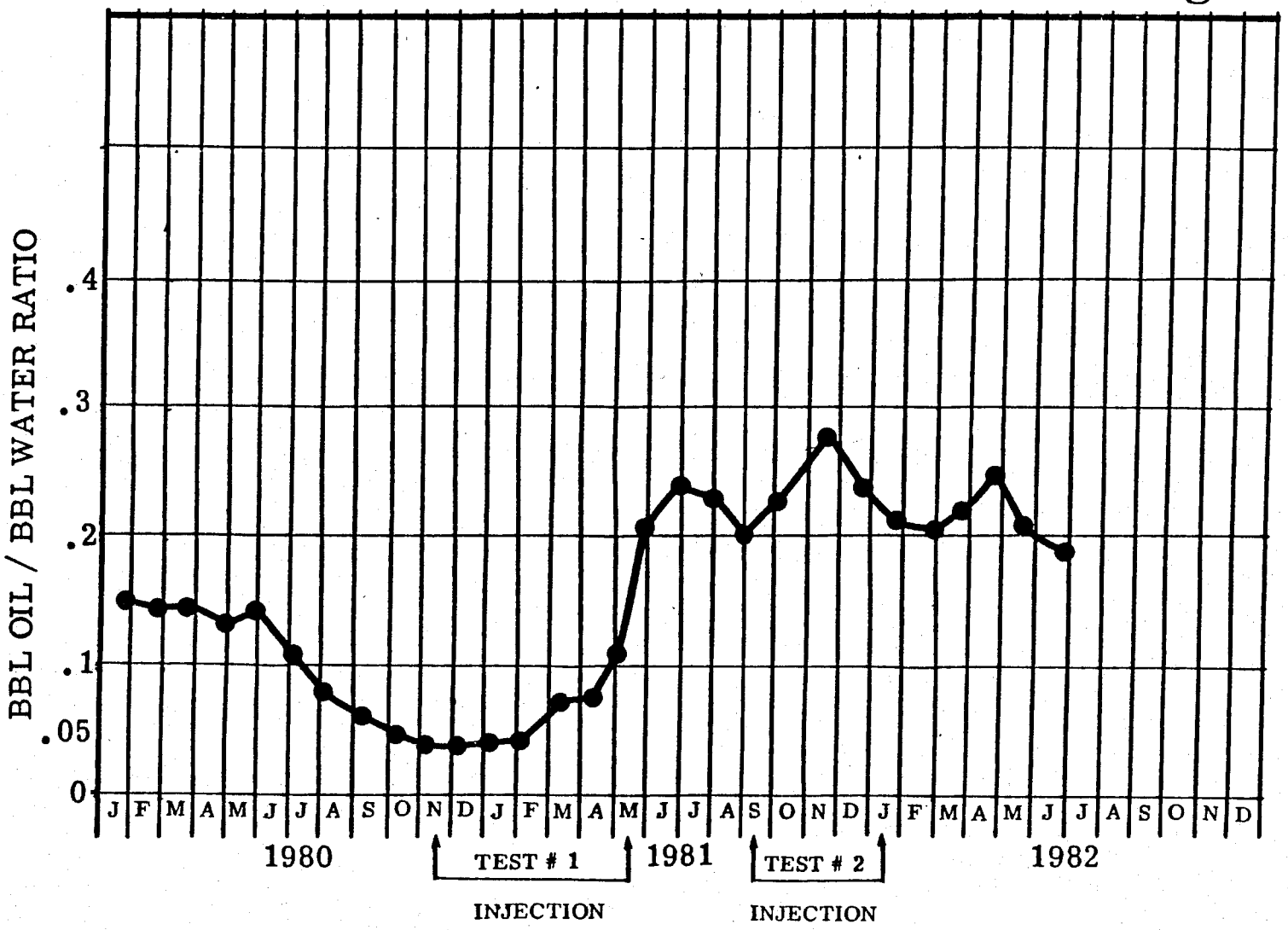

The graph of FIG. 5 illustrates the increase in the oil/steam ratio (e.g. the ratio of the barrels of oil recovered per barrel of water equivalent steam introduced) which results from use of the method of this invention. That ratio was less than 0.05 in late 1980; more than 20 barrels of water equivalent steam were required to produce a barrel of oil. However, by injecting surfactant continuously, this ratio rose to an average of 0.2. At its peak, April, 1982, the method enabled recovery of a barrel of oil using only approximately 3 barrels of water equivalent steam. Energy balance is achieved when less than 19 barrels of water equivalent steam are employed to recover a barrel of oil and economic break even is attained if less than 9 barrels of water as steam are consumed for each barrel of oil produced. It can be seen that by employing the method of this invention, both energy and economic efficiency were achieved.

Figure 6:
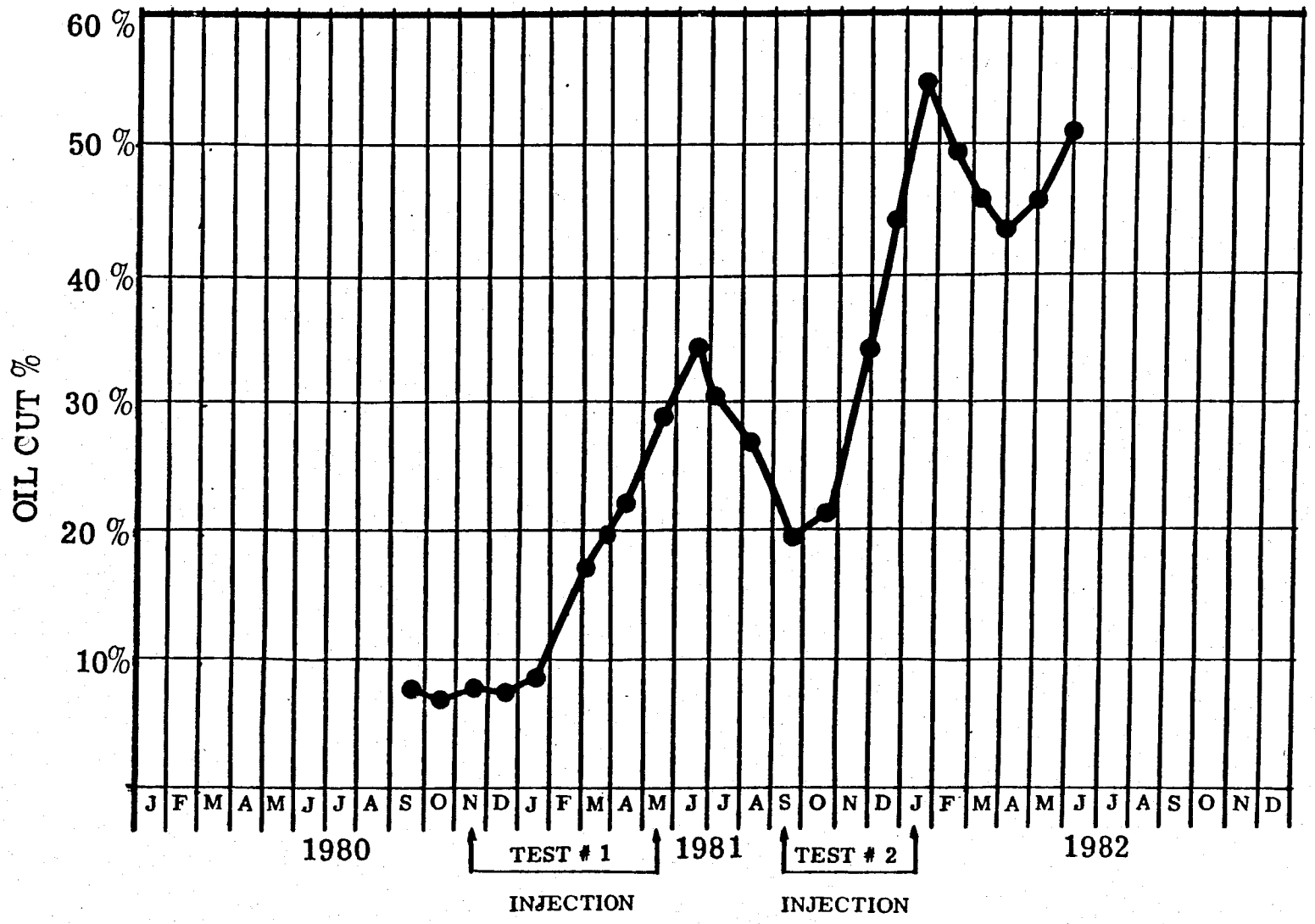

The graph of FIG. 6 illustrates the oil cut achieved in the Midway-Sunset test. The percentage of oil in relation to the total fluid being driven was increased from 5% at the end of the conventional steam drive to between 30% and 50% following introduction of the surfactant—steam—non-condensible gas driving fluid mixture.

The table of FIG. 7 compares the production results achieved by the wells (four X and eight Y) affected by the injected surfactant and those achieved by the four Y wells not affected by the chemical and thus provides a means for exhibiting the enhanced recovery of this method. The twelve affected wells produced an average of 90 barrels of oil per day in 1980. This average increased to 214 barrels per day during 1981. These figures may be contrasted with the results from the four unaffected Y wells wherein production decreased by over 25% from 1980 to 1981. Recovery from the eight affected wells decreased slightly to 197 barrels per day in 1982. Such a dropoff is to be expected as the oil zone becomes increasingly depleted. The 8% decline is less, however, than the 15% drop exhibited during 1982 by the four unaffected wells. Therefore, the process of this invention acts to either enhance the amount of oil recovered or similarly reduce the expected dropoff in oil production.

As indicated by the tables, the oil/steam ratio exhibited by the wells affected by my enhanced steam drive process increased in both 1981 and 1982, the years during which the process was employed. Conversely, the oil/steam ratio of the unaffected wells decreased to 0.05 (20 barrels of steam per barrel of oil) which is below its energy break-even point per steam drive recovery of oil. During 1982 the oil cut of the affected area was measured at 36%, whereas that of the unaffected area was only 15%. Therefore, by introducing the surfactant containing driving fluid of this invention into the test pattern (of FIG. 3), it is evident that enhanced amounts and rates of oil are recovered from the tested oil zone.

It is evident those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. A method of enhanced steam drive recovery of oil from an oil zone disposed below an overburden, said method comprising the steps of:

injecting a surface active agent continuously into a supply of driving steam to uniformly mix said surfactant with said steam injecting a non-condensible gas into said steam-surfactant mixture at a rate of at least 100,000 standard cubic feet per day but no more than 10,000,000 standard cubic feet per day per injection well to provide a driving fluid which includes steam surfactants and non-condensible gas, and introducing said driving fluid into said oil zone under sufficient pressure to cause said fluid to drive through a flow channel between the interface of the oil zone and the overburden thereabove and spread said surfactant evenly therethrough said surfactant reacting with said oil to enable said fluid to strip away a top layer of said oil which is driven to a production well for removal thereof.

2. Method in accordance with claim 1 wherein said fluid is introduced into said oil zone via an injection well.

3. Method in accordance with claim 1 wherein said fluid is introduced at a rate of at least 50 barrels water equivalent per day per acre of oil zone projection but no more than 3,000 barrels of water equivalent per day.

4. Method in accordance with claim 1 wherein said fluid is introduced at a rate of at least 50 barrels water equivalent per day per acre of oil zone projection but no more than 150 barrels of water equivalent per day.

5. Method in accordance with claim 1 wherein said driving fluid includes a concentration of at least 0.05%, but no more than 1.0% surfactant.

6. Method in accordance with claim 1 further including injecting a fluid into said reservoir prior to introducing said driving fluid into said reservoir to at least partly develop a conductive channel for fluids between said injection well and production wells.

7. Method in accordance with claim 1 further including a hydraulic fracture within said reservoir between said injector and production wells.

* * * * *